US011505880B2

(12) United States Patent
Galan Llongueras et al.

(10) Patent No.: US 11,505,880 B2
(45) Date of Patent: Nov. 22, 2022

(54) PROCESS FOR SPINNING AND/OR TWISTING YARNS, MACHINE FOR SPINNING AND/OR TWISTING YARNS AND METHOD TO TRANSFORM A MACHINE FOR SPINNING AND/OR TWISTING YARNS

(71) Applicants: TWISTPERFECT, S.L., Terrassa (ES); CASUMCONI, S.L., Viladecavalls (ES)

(72) Inventors: Jordi Galan Llongueras, Barcelona (ES); Albert Galan Llongueras, Barcelona (ES)

(73) Assignees: TWISTPERFECT, S.L., Barcelona (ES); CASUMCONI, S.L., Barcelona (ES)

( * ) Notice: Subject to any disclaimer, the term of this patent is extended or adjusted under 35 U.S.C. 154(b) by 421 days.

(21) Appl. No.: 16/470,489

(22) PCT Filed: Apr. 7, 2017

(86) PCT No.: PCT/IB2017/052009
§ 371 (c)(1),
(2) Date: Mar. 12, 2020

(87) PCT Pub. No.: WO2018/122625
PCT Pub. Date: Jun. 5, 2018

(65) Prior Publication Data

US 2020/0347521 A1 Nov. 5, 2020

(30) Foreign Application Priority Data

Dec. 30, 2016 (ES) ..... ES201631732
Mar. 16, 2017 (ES) ..... ES201730352

(51) Int. Cl.
*D01H 1/42* (2006.01)
*D01H 7/86* (2006.01)
*D01H 7/18* (2006.01)

(52) U.S. Cl.
CPC ..... *D01H 1/42* (2013.01); *D01H 1/425* (2013.01); *D01H 7/86* (2013.01); *D01H 7/18* (2013.01); *D01H 2700/24* (2013.01)

(58) Field of Classification Search
CPC ..... D01H 7/86; D01H 7/18; D01H 1/425; D01H 1/10; D01H 1/02; D01H 2700/24
See application file for complete search history.

(56) References Cited

U.S. PATENT DOCUMENTS 2,386,704 A * 10/1945 McLellan ..... D01H 1/425 57/357
2,473,520 A * 6/1949 Gwaltney ..... D01H 1/02 57/75

(Continued)

FOREIGN PATENT DOCUMENTS

CH 684099 A5 * 7/1994 ..... D01H 1/42
CN 1882725 A 12/2006

(Continued)

OTHER PUBLICATIONS

Tang, Z.-X. et al., "An Experimental Investigation of Yarn Tension in Simulated Ring Spinning", Fibers and Polymers, 2004, pp. 275-279, vol. 5, No. 4.

(Continued)

*Primary Examiner* — Shaun R Hurley
*Assistant Examiner* — Patrick J. Lynch
(74) *Attorney, Agent, or Firm* — Blue Filament Law PLLC

(57) ABSTRACT

A process is provided of yarn spinning and/or twisting, in which a yarn runs between a yarn feeder towards a yarn (Continued)

Figure 1:
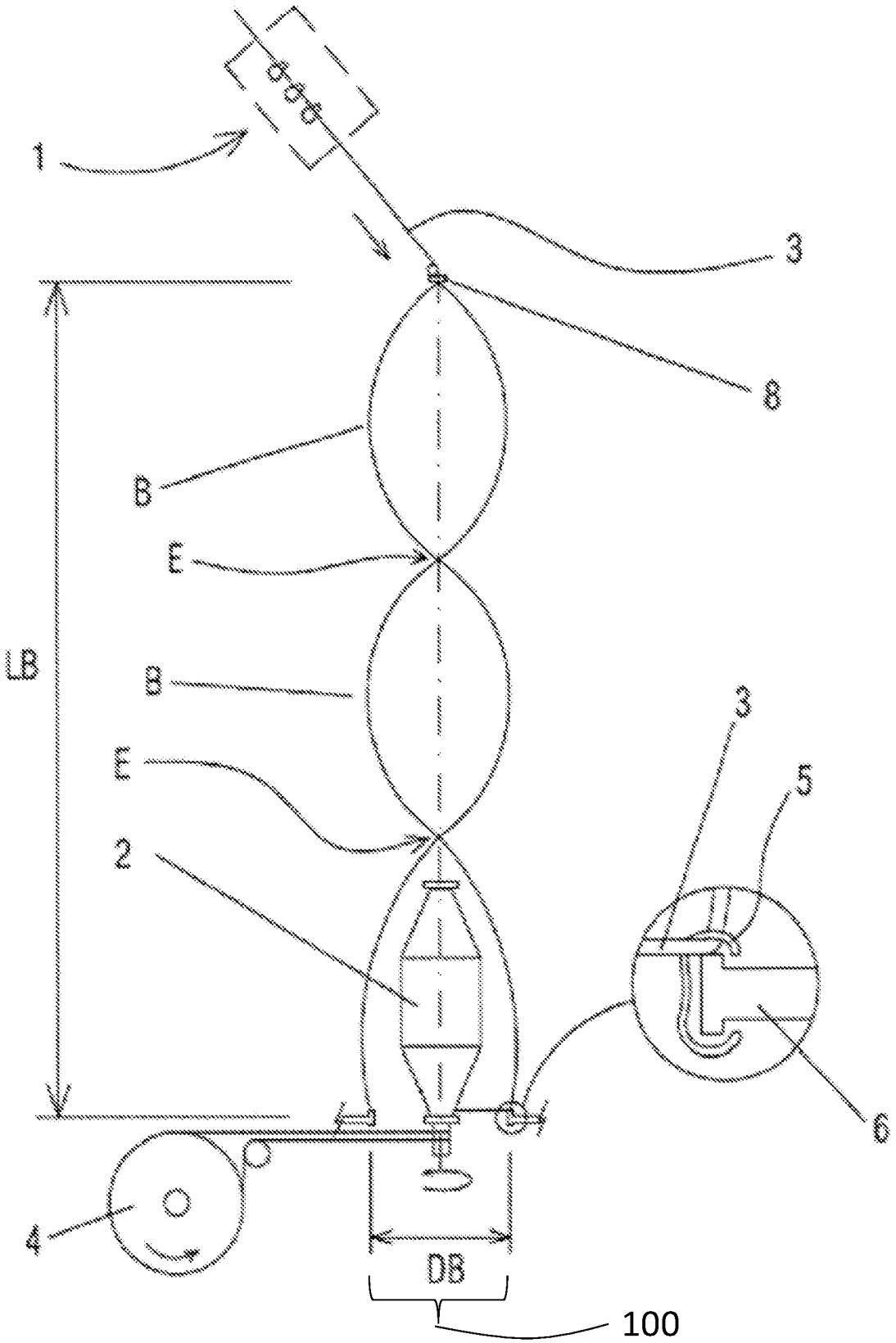

picker. A driver rotates the yarn picker at a predetermined speed, in which a stretch of balloon is generated in a point located between the yarn feeder and the yarn picker by the presence of a ring. A helical path with oscillating spiral diameters exists between the yarn feeder and the yarn picker, so that the path of the yarn through the ring, creates a body of revolution from a diameter generating a balloon that has at least a hyperboloid structure forming at least two stretches of balloons consecutive to each other. A machine for performing the process is also provided.

8 Claims, 10 Drawing Sheets

(56) References Cited

U.S. PATENT DOCUMENTS

| | | | | |
|---|---|---|---|---|
| 3,438,187 A | | 4/1969 | Escursell-Prat | |
| 3,747,314 A | * | 7/1973 | Kilduff | D01H 15/013 57/86 |

FOREIGN PATENT DOCUMENTS

| | | | | | |
|---|---|---|---|---|---|
| CN | 104499129 | A | | 4/2015 | |
| DE | 505038 | C | | 8/1930 | |
| DE | 4128523 | C1 | | 1/1993 | |
| GB | 1116413 | A | * | 6/1968 | D01H 15/013 |
| GB | 1116413 | A | | 6/1968 | |
| GB | 1237944 | A | | 7/1971 | |
| JP | 2000129543 | A | | 5/2000 | |
| JP | 2008223157 | A | | 9/2008 | |
| KR | 0138785 | B1 | | 5/1998 | |

OTHER PUBLICATIONS

Tang, Z.-X. et al., "Modelling yarn balloon motion in ring spinning", Applied Mathematical Modelling, 2007, pp. 1397-1410, vol. 31, No. 7, © 2007 Elsevier Inc.

IIT Delhi, "Ring Spinning Machine", Textile Engineering—Yarn Manufacture II, Course made available Jul. 16, 2013, 14 pages, © 2009-2011 IIT Delhi; https://nptel.ac.in/courses/116102038/25.

English translation of International Search Report dated Dec. 12, 2017 for International Application No. PCT/IB2017/052009 filed Apr. 7, 2017.

* cited by examiner

PROCESS FOR SPINNING AND/OR TWISTING YARNS, MACHINE FOR SPINNING AND/OR TWISTING YARNS AND METHOD TO TRANSFORM A MACHINE FOR SPINNING AND/OR TWISTING YARNS

OBJECT OF THE INVENTION

This application has as object the registration of a process for spinning and/or twisting yarns with multiple stretches of balloon, which process is designed to be carried out by means of a yarn twisting or spinning machine.

More specifically, the invention proposes to develop a method for spinning and/or twisting yarns that allows working faster without it means increasing the tension of the yarn that occurs in the process of spinning and/or twisting, as well as a machine for spinning and/or twisting yarns using that method and a method to transform a machine for spinning and/or twisting yarns.

BACKGROUND OF THE INVENTION

In the textile industry, and namely in the spinning and twisting industry the use of continuous ring spinners, ring twisters, multiple twist twisters, double twist twisters, vertical cabling, cabling twister etc. is well-known.

All these machines to provide twist to the yarn are obliged to rotate the yarn at a distance with respect to the centre of rotation with the purpose of saving a space occupied by a part of the machine and this generates a revolution figure named "balloon". This balloon is defined by an area or volume of revolution with a central spin axis, for example, with a conical volume.

The trend of the manufacturers of spinning and twisting machines is to suppress or reduce the balloon by limiting it physically in order to avoid an increase of the diameter of the balloon and to reduce the height of the balloon as much as possible. This way, the tension generated in the yarn for the process of twisting and/or spinning are lower in order to avoid possible damages to the yarn, affecting its quality, breakages during the production process, therefore the rotation or angular speed is limited and has to be reduced, or in other words, it cannot be increased having therefore a negative effect on the productivity.

Tang et al in "Modelling yarn balloon motion in ring spinning", Applied Mathematical Model, Guildford GB vol 31, (Feb. 1, 2007), pages 1397-1410, (ISSN 0307-904X) and Zheng-Xue Tang et al in "*An experimental investigation of yarn tension in simulated ring spinning*", Fibers and Polymers vol 5, (Dec. 1, 2004), pages 275-279 (ISSN 1229-9197) suggests that a free balloon model might be advisable. However, in "*Engineering Fundamentals of Ring Spinning, Over-End Unwinding and Two-For-One Twisting in Textile Processes*" (ISBN 978-1-60595-172-0) a co-author of both documents (W Barrie Frasier) acknowledges that this model is not readily applicable in a twisting or spinning machine.

In "NPTEL:: Textile Engineering—Yarn Manufacture—II" a basic understanding of stationary waves on a yarn is taught. There is no mention to its advantages or how to apply said stationary wave in a twisting machine.

DESCRIPTION OF THE INVENTION

This invention was developed in order to provide a method configured as a novelty within the field of application and it solves the above-mentioned drawbacks, providing in addition other further advantages that will be apparent from the description below.

Therefore an object of this invention is to provide a process for spinning and/or twisting yarns having multiple stretches of balloon, in which a yarn runs between a yarn feeding means (such as for example at least a bobbin) towards a yarn picking means, this yarn picking and/or winding means connected to driving means to rotate the yarn picking means at a predetermined speed, in which a stretch of balloon is generated at a point located between the feeding means and the picking means because of the presence of twisting means. Namely, the invention is characterized in that the rotation speed value of the yarn twisting means is such that the path the yarn follows between the feeding means and the picking (or winding) means, by operating the twisting means, generates a helical path with oscillating spiral diameters along the distance existing between the feeding means and the yarn picking and/or winding means such that a revolution body is created that has at least a hyperboloid structure forming at least two stretches of balloon consecutive to each other.

According to another feature of the invention, the process can be carried out by means of multiple hyperboloid structures defining a number of hyperboloids ranging from 2 to 20.

In working conditions with determined parameters, the increase of the stretches of balloon, that in turn implies an increase of the hyperboloid structures, is achieved by increasing the height of the stretch of balloon and, therefore, to increase the diameter value of times generating the already established stretch of balloon, so that values of the height of the stretch of balloon are increased from 5 to 50 times the diameter generating a stretch of balloon as it is wished to increase the stretches of balloon, and therefore, increasing the hyperboloid structures that would pass from 2 to 20 as such height is being increased.

That is why the twisting is produced by means of multiple stretches of balloon that offsets the tension of the work so that the tension produced by tension means is lower than in the traditional spinning and/or twisting processes.

Thanks to these characteristics, it is possible to produce yarn spinning and/or twisting at higher speed and therefore, with a higher rate of productivity, with a low tension of the yarn, and a lower energy consumption allowing to cut down the costs of production and upgrade the quality of the yarn.

The tension that can be generated in the yarn by the effect of the rotation speed centrifugal forces, is counteracted in the inflection points between the stretches of balloon.

Another advantage this method provides is that it allows twisting very thin yarns with a low level of tension, which extends to handling new very delicate yarns that currently are broken when working with tension they cannot absorb.

This method is suitable for every yarn, fibre, filament, rope, ribbon, etc., as well as natural, synthetic and artificial materials. It can result especially suitable for handling fiberglass, carbon, aramid fibers, etc., because it allows to work at higher speed and with a lower level of tension.

Preferably, the height of the stretches of balloon is at least two times the diameter generating the stretch of balloon.

In an even more preferred embodiment, the height of the stretches of balloon ranges from 5 to 50, especially from 5 to 25 times the diameter generating the stretch of balloon.

This range of height is preferably distributed so that for diameters generating, for example, 200 mm or 216 mm or 250 mm or 300 mm or 330 mm or 400 mm or 500 mm, and depending on the thickness of the yarn to be processed 2 stretches of balloon can be obtained (i.e., a hyperboloid structure) with heights of 5 times the diameter generating the stretch of balloon, or as the thickness of the yarn increases, this height needs to be increased 6 times the diameter generating the stretch of balloon, or 7 times the diameter generating the stretch of balloon, even 8 times the diameter generating the stretch of balloon.

On the other hand, if the generating diameter is being reduced to values, such as for example, 165 mm, or 140 mm or 120 mm or 100 mm down to 30 mm, so that two stretches of balloon are obtained, the height is determined with a relation 5 times the diameter generating the stretch of balloon, or six times the diameter generating the stretch of balloon, or even seven times the diameter generating the stretch of balloon such value evolving in different way than with large generating diameters.

In addition, preferably, the height of the stretches of balloon is at least two times the height of the picking means.

In the same way, it can also be preferable that the height of the stretches of balloon is at least two times the height of the feeding means.

According to another feature of the invention, the yarn passing through a tension means located at a point prior to the yarn picking and/or feeding means, namely, in yarn ring spinning and ring twisting. In the case of double twisting, direct cabling and vertical machines, the tension is also adjusted by other external means.

Preferably, the tension means in ring spinner and ring twister includes a cursor that is coupled to a bobbin rail connected to the winding bobbin.

A second feature of the invention is a yarn spinning and/or twisting machine, that includes:

- a yarn feeding means,
- a yarn picking means,
- twisting means located between the yarn feeding means and the yarn picking means that generate a diameter generating a stretch of balloon of yarn in an area generating a stretch of balloon,
- driving means connected to the yarn feeding and/or picking means, and The said machine is characterized in that the distance existing between the guiding means and the area generating the stretch of balloon is at least two times the diameter generating a balloon, so that at least two stretches of balloon are generated between the guiding means and the area generating a stretch of balloon. It is essential that the machine does not include elements limiting the balloon. It shall be understood as limiting the balloon any element that makes contact with the yarn in the area where the balloons are generated.

It must be said that in the case of ring spinners and ring twisters, an increase of the number of the stretches of balloon is associated to a decrease of the sizes of the cursor and therefore of the weight of the cursor itself with the subsequent advantages that means.

A third feature of the invention is a method to transform a yarn spinning and/or twisting machine characterized in that it includes a step in which the height of the stretch of balloon is increased either by lifting the yarn feeding means and/or guiding means with respect to the yarn picking means so that the path of the yarn, or lifting the yarn picking means with respect to the yarn feeding means.

Consequently, to the increase of the height of the stretch of balloon and by operating the twisting means, a body of revolution is created from a diameter generating a balloon that has at least a hyperboloid structure forming at least two stretches of balloon consecutive to each other.

Other characteristics and advantages of the method object of this invention shall be apparent from the description of a preferred but not exclusive embodiment that is illustrated as a non-limiting example in the drawings attached in which:

SHORT DESCRIPTION OF THE DRAWINGS

Figure 2:
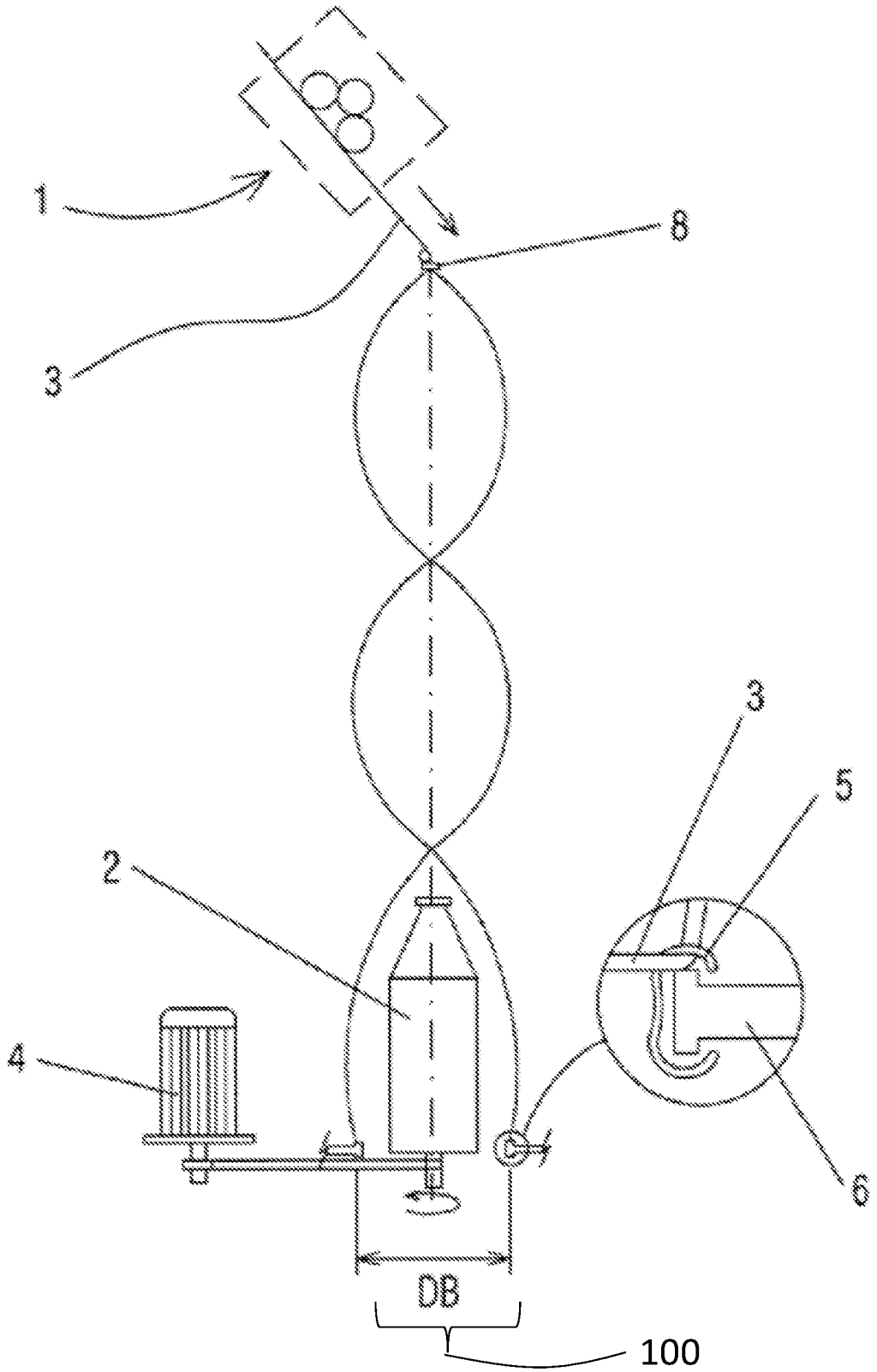
Figure 3:
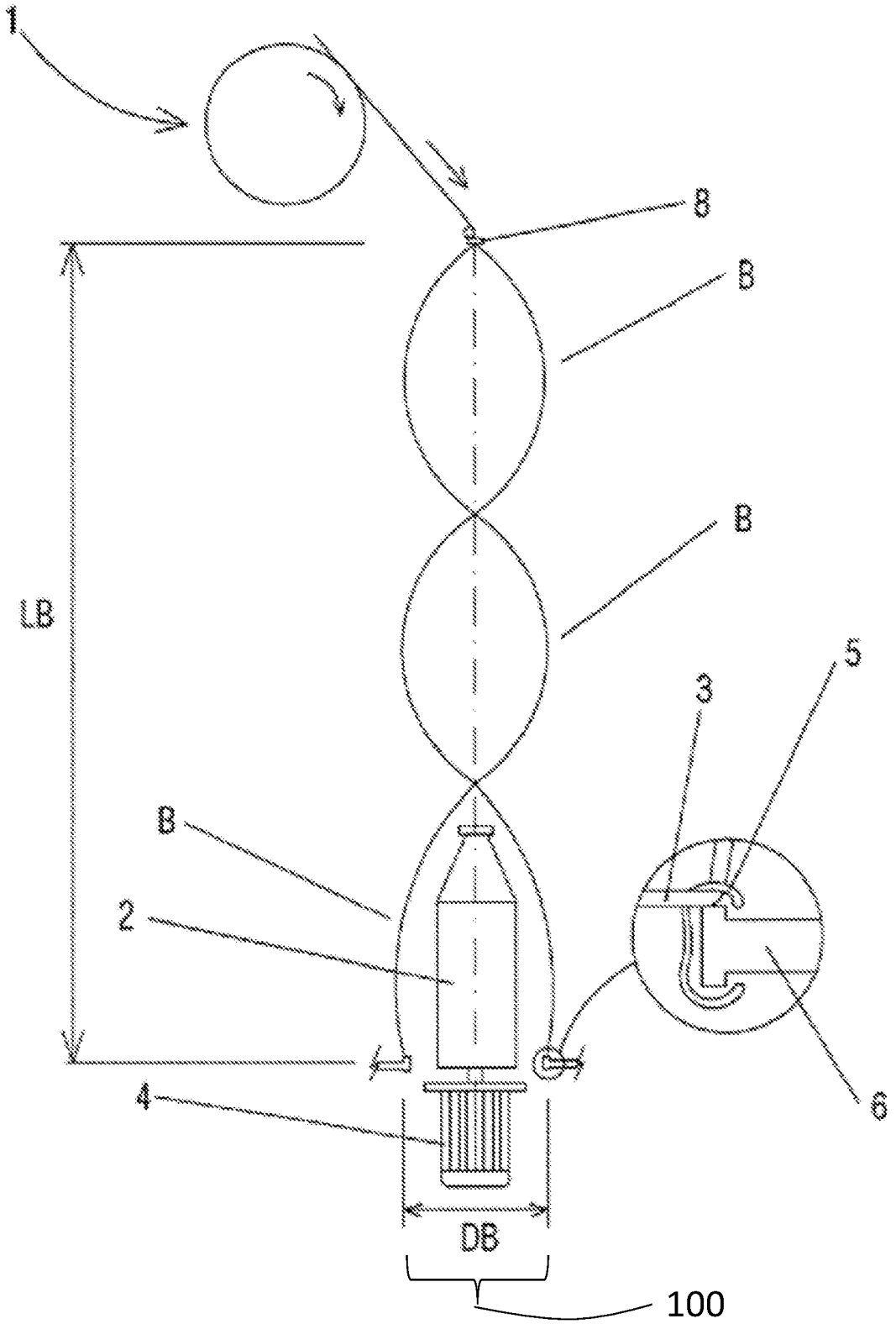
Figure 4:
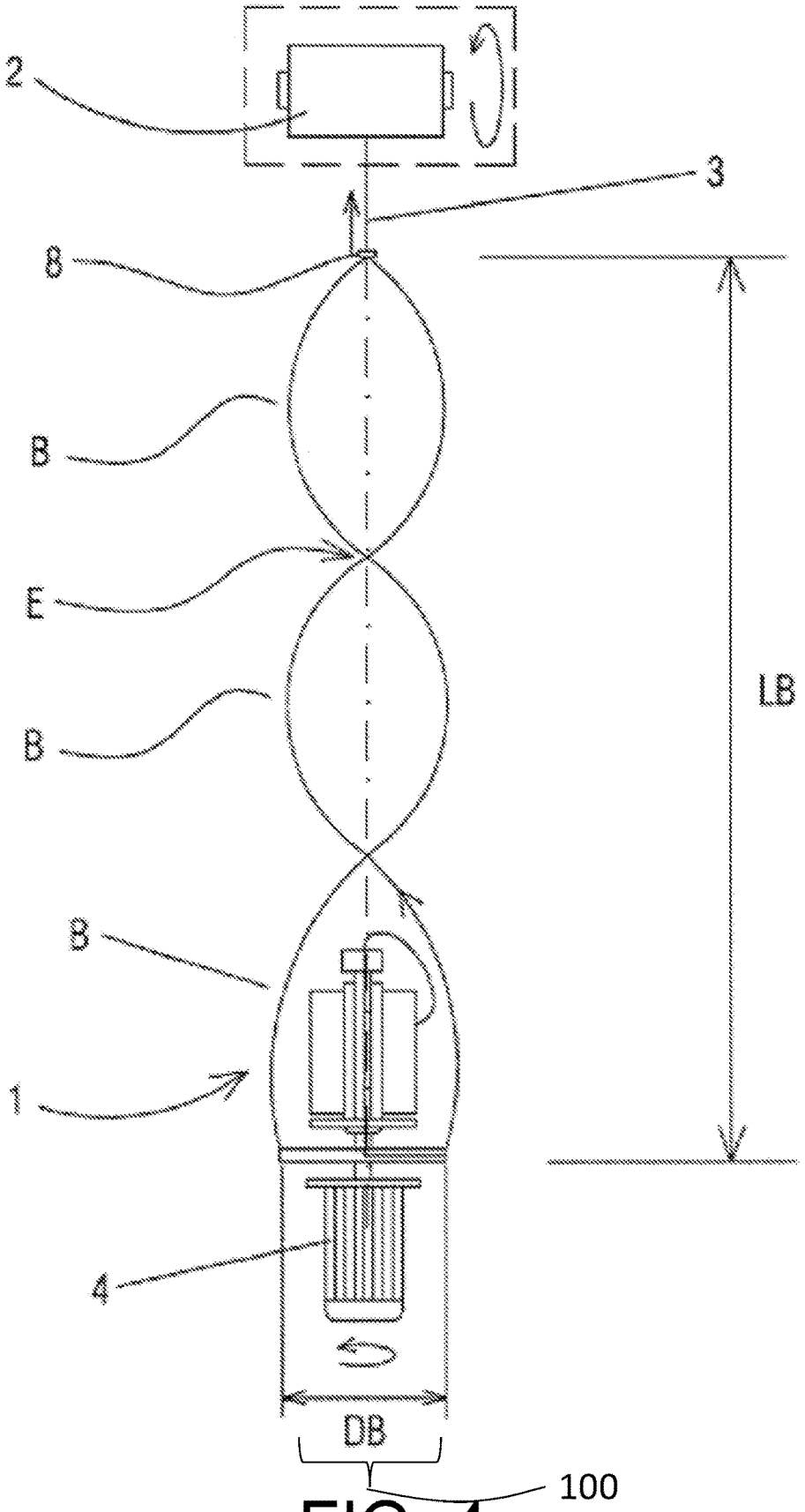
Figure 5:
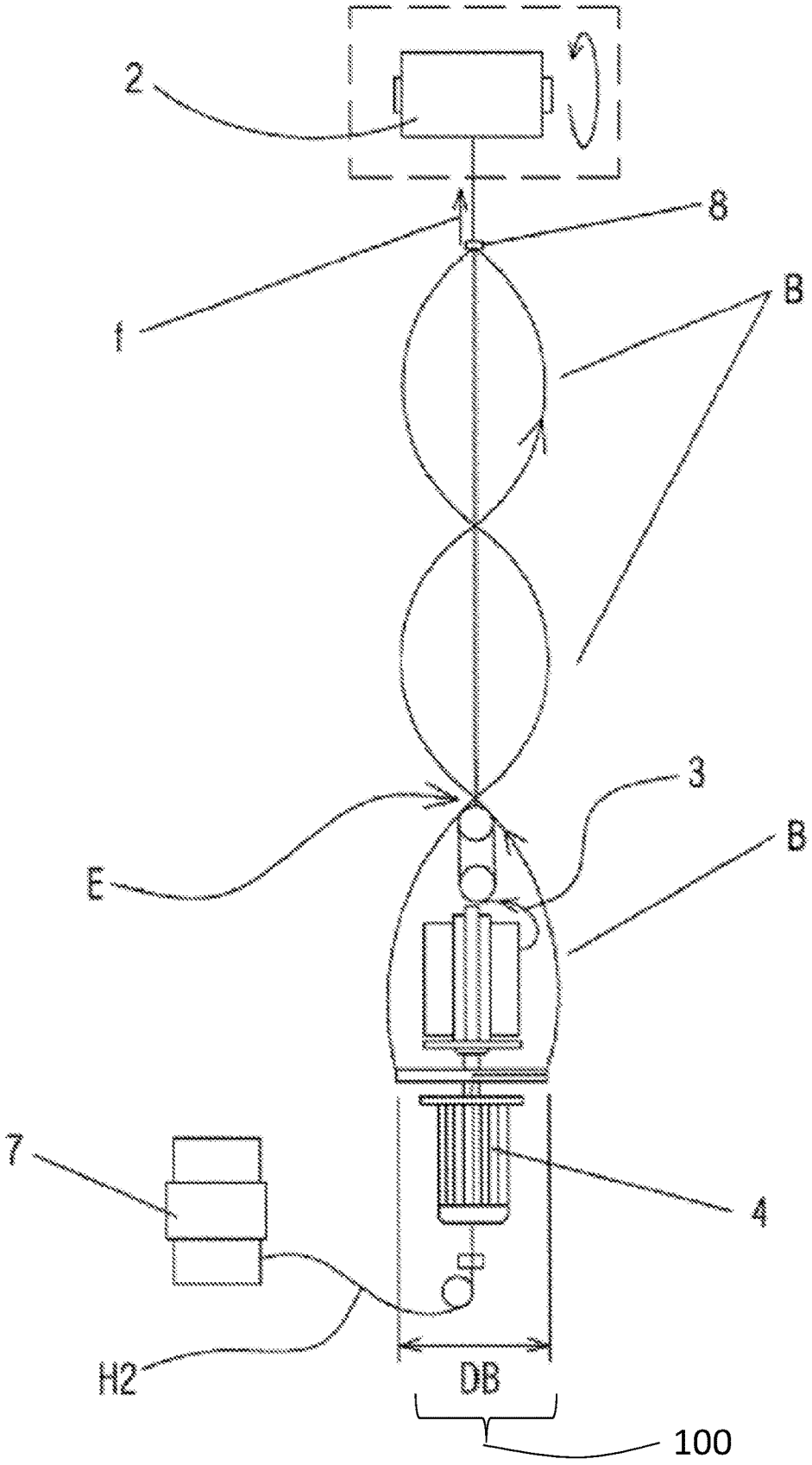
Figure 6:
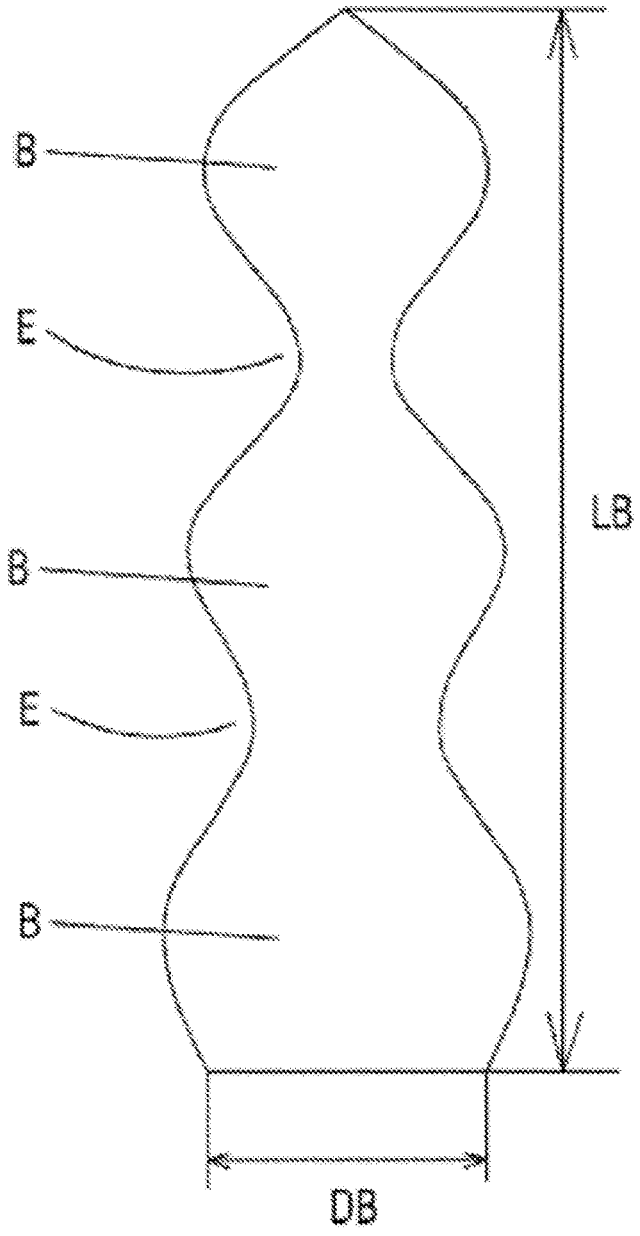
Figure 7:
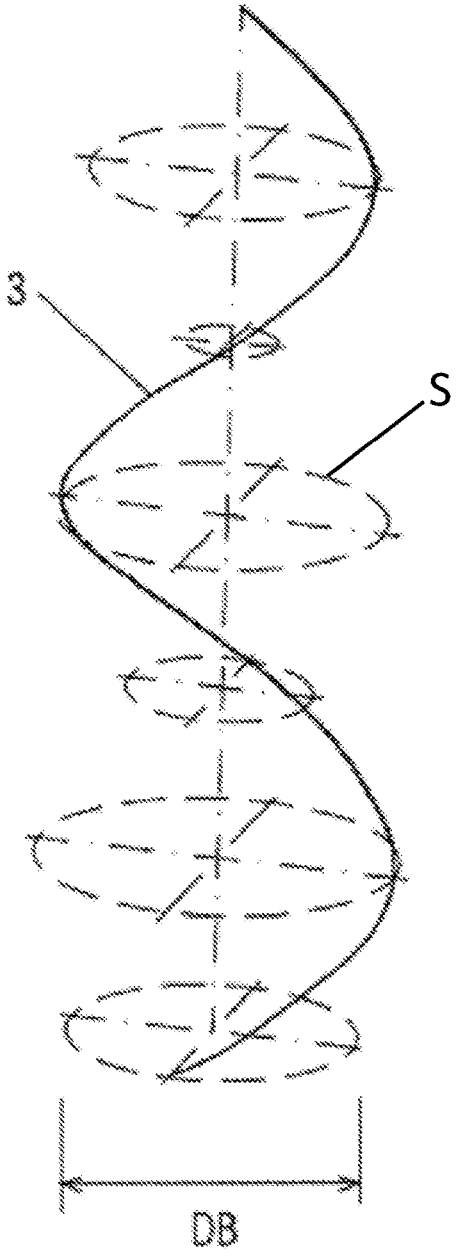

FIG. 1. Is a schematized view of a first embodiment of a continuous ring spinner that uses the method according to this invention that includes a detailed view of the cursor;

FIG. 2. Is a schematized view of a second embodiment of a ring twister machine that uses the method of the invention that includes a detailed view of the cursor;

FIG. 3. Is a schematized view of a third embodiment of another ring twister machine that uses the method of the invention that includes a detailed view of the cursor;

FIG. 4. Is a schematized view of a fourth embodiment a double twist twister that uses the method of the invention;

FIG. 5. Is a schematized view of a fifth embodiment of a vertical cabling machine that uses the method of the invention;

FIG. 6. Is a schematized view of the geometrical shape the yarn adopts during the twisting process according to this invention;

FIG. 7. Is a schematized view of a path a yarn can take in a process according to this invention; and FIG. 8. Is a schematized view showing a machine that uses means for stretching the yarn combined with a guiding means.

Figure 9:
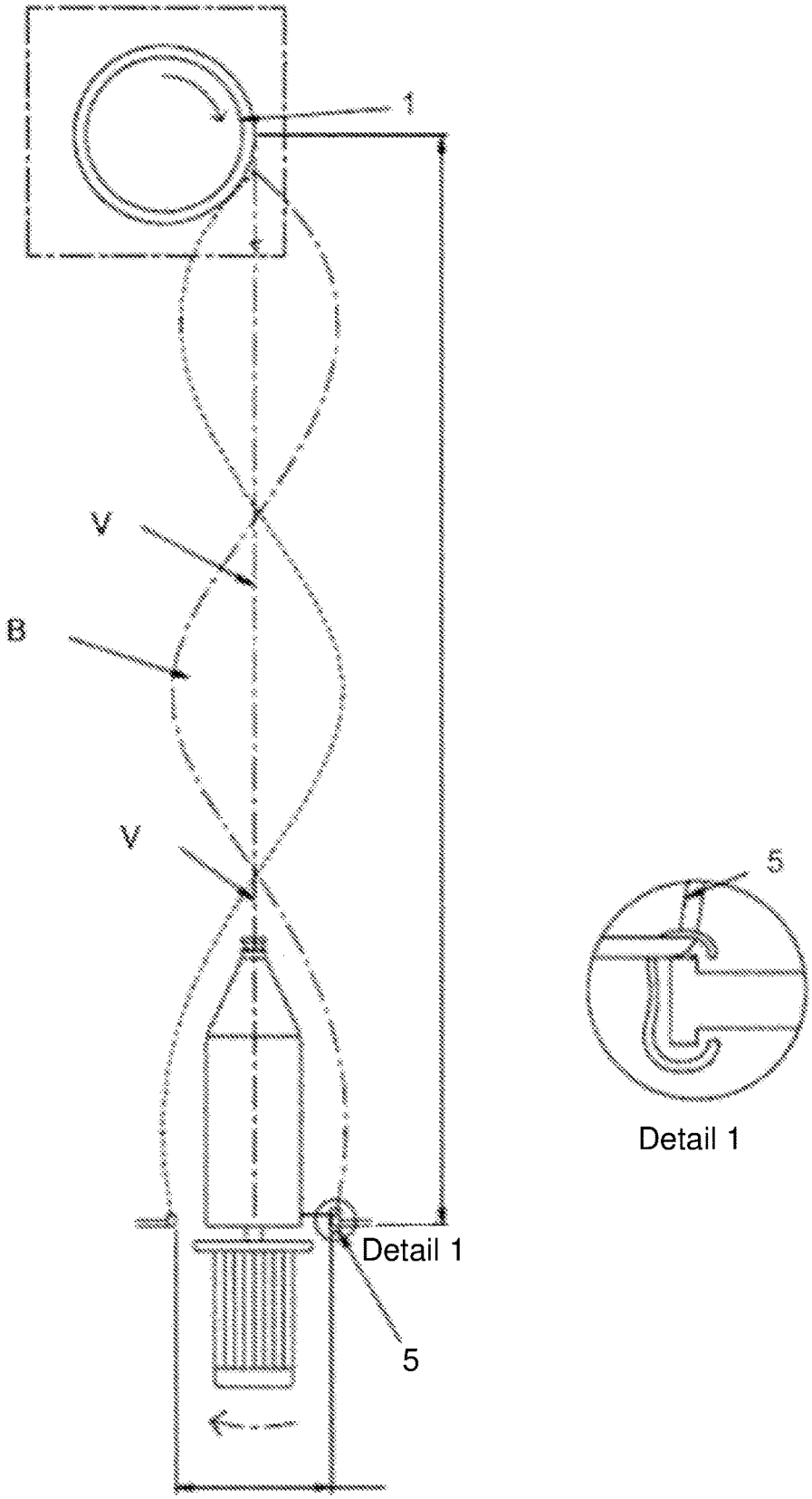

FIG. 9. Is a schematized view showing a ring twister without guiding means.

Figure 10:
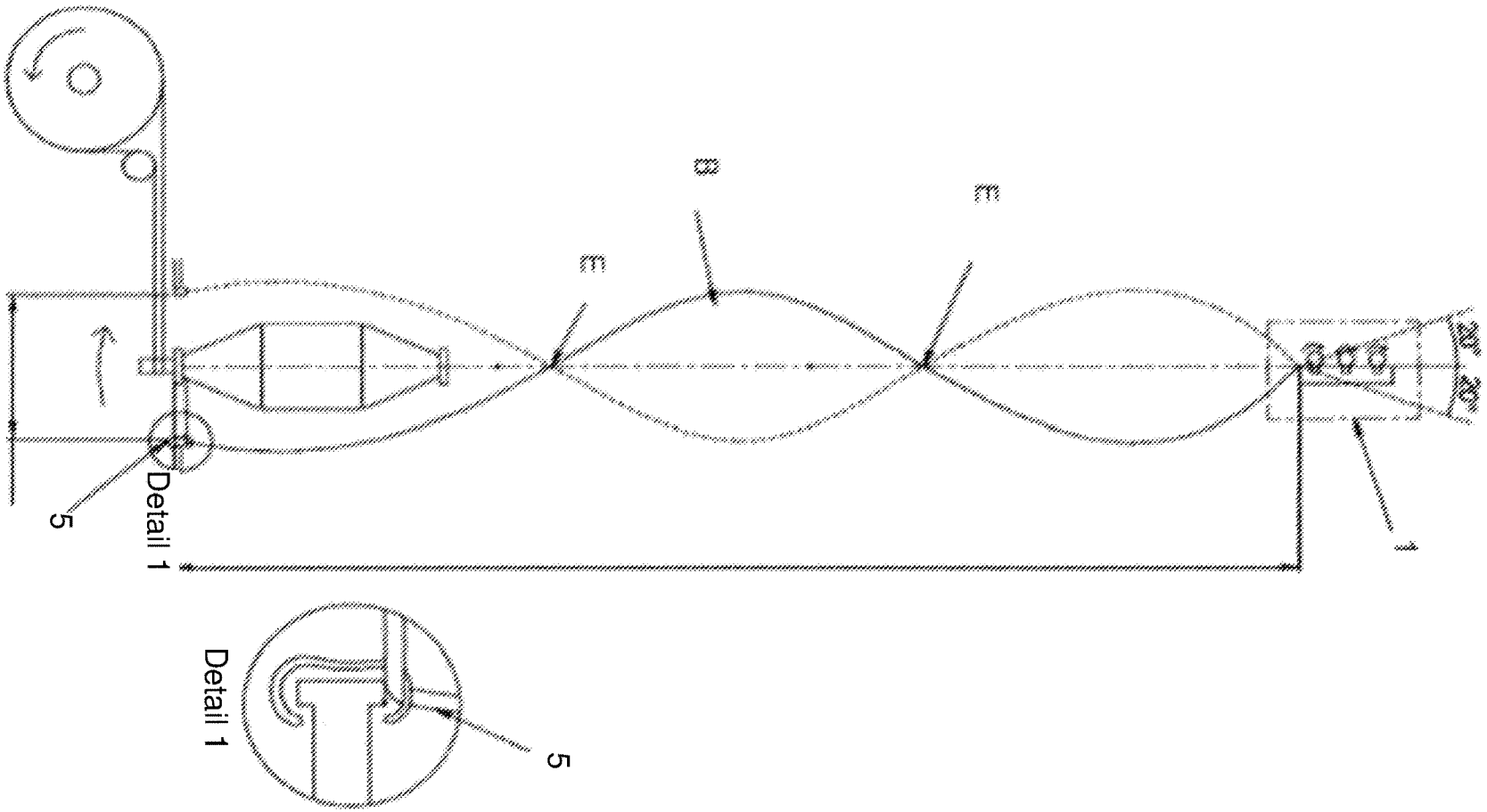

FIG. 10. Is a schematized view showing a machine that uses yarn-stretching means without a guiding means.

Figure 11:
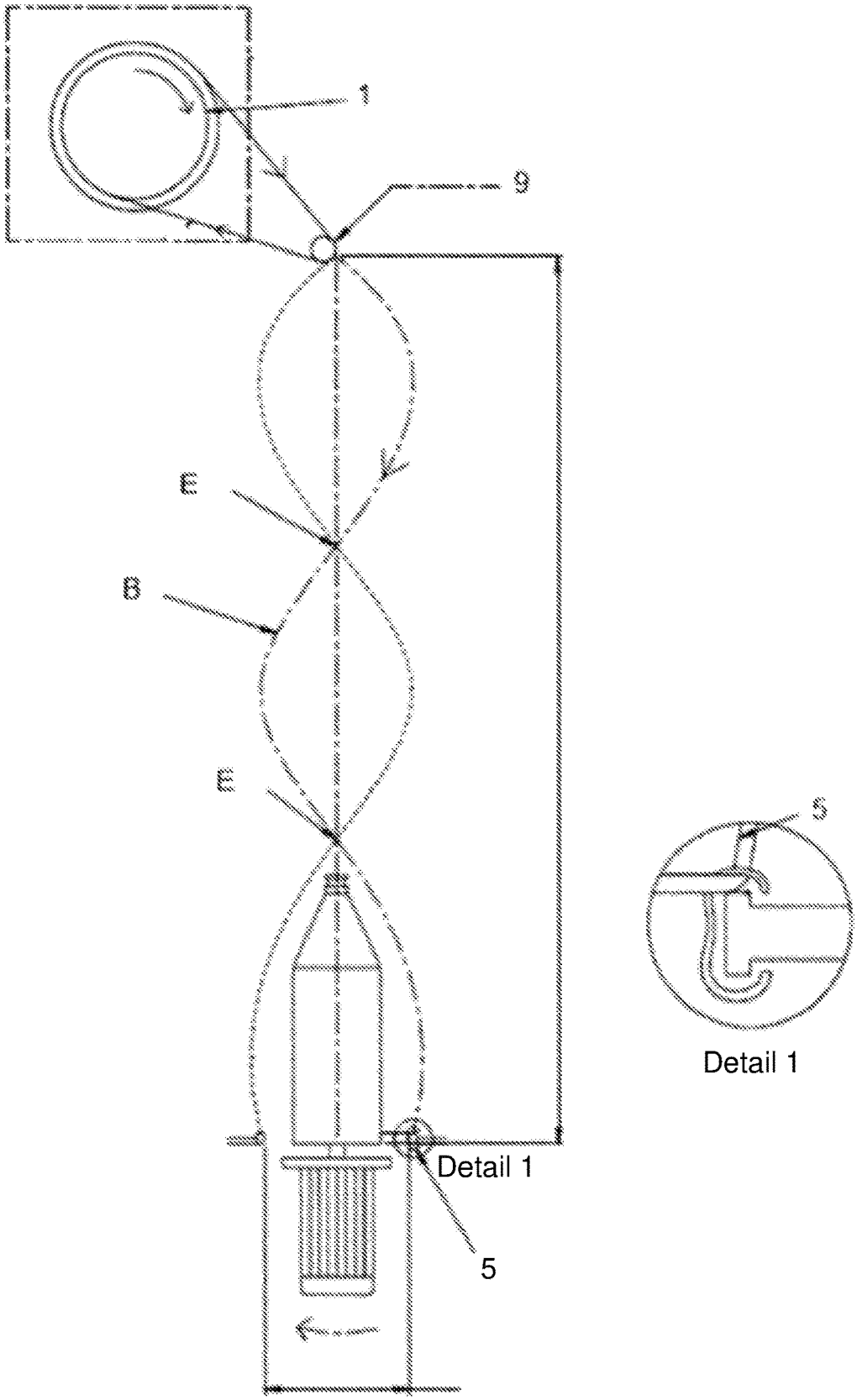

FIG. 11. Is a schematized view of a ring twister that uses a roller as guiding means;

DESCRIPTION OF A PREFERRED EMBODIMENT

In view of the mentioned figures and in accordance with the numbering adopted, an example of preferred embodiment can be seen, that includes the parts and elements indicated and described in detail below.

In all the preferred embodiments of the spinning and twisting machine described below, the value of the rotation speed of the winding bobbin is such that an helical path is generated, with an oscillating spire diameter (S), (see FIG. 7) along the distance (LB) existing between the feeding means and the winding bobbin such that a body of revolution is created that has two consecutive hyperboloid structures (E) forming a plurality of stretches of balloon (B) consecutive to each other.

Another feature of the invention is, as it is shown in the FIG. 1, a ring spinner having on the top a yarn feeding system, indicated generally with reference (1) that is of a conventional type therefore it shall not be described in more details, while at the bottom a bobbin (2) is provided for picking the yarn (3) that rotates motor-driven by conventional driving means (4) shown schematized. The yarn (3) that is wound in the bobbin enters perpendicularly with respect to the bobbin side wall as the yarn is made to pass by a tension element named cursor (5) placed in a bobbin rail (6) that picks the yarn that has been twisted and stores it in the bobbin (2). The said cursor (5) is best apparent in the enlarged detail included in the FIG. 1.

During the yarn winding process (3) in the embodiments shown herein, three stretches of balloon (B) are formed (the number of stretches of balloon being not limitative) between a yarn guiding means (8) (indicated schematized), as for example, a small-diameter ring and an area generating a stretch of balloon provoked by twisting means 100 so that a stretch generating diameter (DB) is generated of the structure with multiple stretches of balloon of yarn, in which are defined two strangling of hyperboloid stretches (E) that allow to reduce the level of tension of the yarn. An essential characteristic of the machine is the nonexistence of elements limiting the balloon. It shall be understood by limiting the balloon any element that makes contact with the yarn in the stretch where the balloons are generated.

It shall be mentioned that the distance (LB) existing between the guiding means and the area generating the stretch of balloon is at least two times the diameter generating the balloon (DB), so that at least two stretches of balloon are generated between the guiding means and the area generating a stretch of balloon.

It has to be said that the number of stretches of balloon (B) can be increased or reduced (the minimum being two stretches of balloon) by increasing or reducing the distance (LB) existing between the yarn guiding element and the element responsible of provoking the twisting, in this case represented, the cursor (5).

In a preferred embodiment, the height of the stretches of balloon is ranging from 5 to 50 times the diameter generating the stretch of balloon.

In an even more preferred embodiment, the height of the stretches of balloon is ranging from 5 to 25 times the diameter generating the stretch of balloon.

In a non-limitative example of embodiment, with a generating diameter (DB) of 36 mm eight hyperboloid structures can be obtained (i.e., nine stretches of balloon) with a height of stretch of balloon equivalent to 50 times the generating diameter of 36 mm for a yarn with a 30 Nm titer.

By "titer" is meant the relation existing between the weigh and the length of a yarn, the former being a fixed value and the later a variable value.

The FIG. 2 shows a ring twister with a yarn feeding roller from a static creel in which the same common elements have the same numeral references, the feeding means being generally indicated with the reference (1), arranged on the top and the yarn picking (3) bobbin (2) at the bottom of the machine.

The FIG. 3 shows a ring twister, which is especially suitable for processing fiberglass, in which the same common elements have the same numeral references the feeding means (1) being arranged on the top and the yarn picker (3) proximal to the bobbin (2) at the bottom of the machine, therefore the direction of the yarn is downwards, as in the embodiments of machines shown in the FIGS. 1 and 2.

The FIG. 4 shows a double twisting twister in which the same common elements have the same numeral references.

The FIG. 5 shows a vertical cabling machine with two yarns in which the same common elements have the same numeral references, in which the direction of the operation is upwards the same as the machine shown in the FIG. 4 and indicated by means of the arrow (f), i.e., the picking bobbin is arranged on the top while at the bottom there is the means feeding a first and second yarns that are interlocked to each other. In this machine, the yarn (3) and the additional yarn (H2) are joined, in which the additional yarn (H2) is supplied by a feeder (7).

Figure 8:
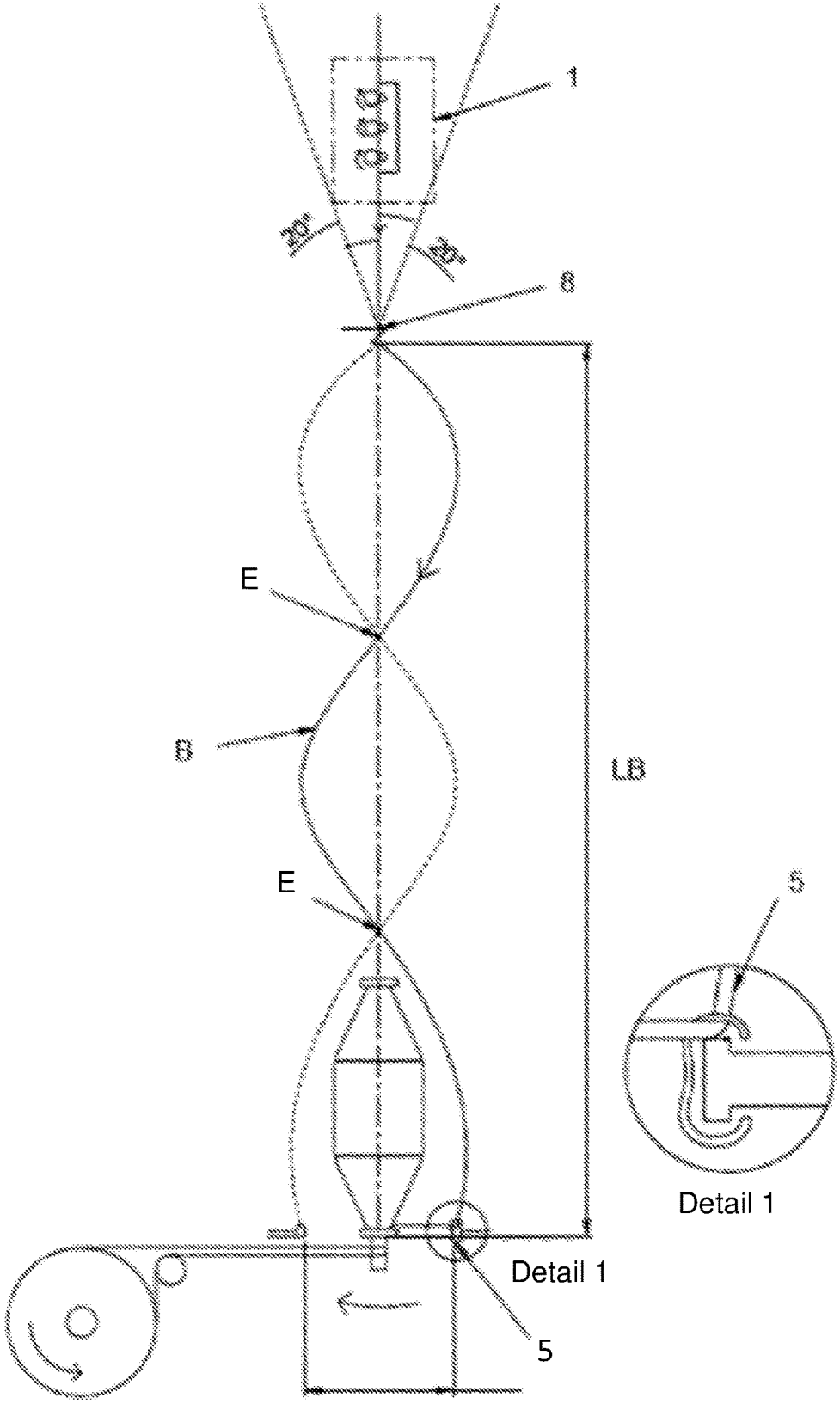

The FIGS. 6 to 8, show a geometrical profile that the yarn adopts during the twisting process, in which three stretches of balloon (FIG. 6) are formed as well as the actual path a yarn can carry out during the process of handling a yarn.

In a preferred embodiment, the yarn spinning and/or twisting machine is comprised of, means to increase or reduce the height of the stretch of balloon (LB) (no shown). This characteristic facilitates the access to the yarn feeding means (1) or to the yarn picking means (2) that during the operation of the machine are not easily accessible for the user as they are in a too high position. Thus, the means to increase or reduce the height of the stretch of balloon (LB) allow, when it is necessary, for example to replace a bobbin, reduce the height of the stretch of balloon in order that the user have an easy access to the yarn feeding means (1) or to the yarn picking means (2). After replacing the bobbin, the means to increase or reduce the height of the stretch of balloon (LB) allows that, the yarn feeding means (1) or the yarn picking means (2) come back to their operating position.

In a preferred embodiment, the guiding means (8) for guiding the yarn (3) move in height associated to the movement in height of the bobbin rail (6) and cursor (5). The movement in height of the bobbin rail (6) and cursor (5) facilitates picking the yarn in the yarn picking means handled (3), such as a bobbin (2), that remains fixed in height. The movement of the guiding means (8) associated to the movement in height of the bobbin rail (6) and cursor (5) allows that the height of the stretches of balloon (LB) remains unchanged avoiding thus variations of the shape of the balloons. Optionally the yarn feeding means (1) move in height jointly with the guiding means (8)

In a preferred embodiment (FIG. 9) the yarn feeding means (1) or the yarn picking means is located so that the exit of the yarn of the yarn feeding means (1) or the entrance of the yarn of the yarn picking means (2) is located approximately on the vertical axis (V) of the stretch of balloon.

In a preferred embodiment of the guiding means (8) for guiding the yarn (3), especially when it is a delicate yarn, is a roller (9) (FIG. 11). Optionally the roller (9) can have a forced rotatory movement associated to the rotatory movement of the yarn feeding means (1) in order to reduce the friction of the yarn that is generated when the yarn makes contract with the roller (9).

In a preferred embodiment, the yarn feeding means (1) is comprised of yarn stretching means (FIGS. 8 and 10). Optionally the direction followed by the yarn within the yarn stretching means is at an angle ranging from −20° to +20° with relation to the vertical (V). In an even more preferred embodiment, the direction followed by the yarn within the yarn stretching means is coincident with the vertical (V). In any of the said cases, guiding means (FIG. 10) can be not required.

A third feature of the invention is a method to transform a yarn spinning and/or twisting machine characterized in that it includes a step in which the height of stretch of the balloon (LB) is increased so that, by operating the twisting means 100 a body of revolution is created from a diameter generating a balloon that has at least a hyperboloid structure (E) forming at least two stretches of balloon (B) consecutive to each other.

The increase of the stretch of balloon (LB) is achieved by lifting the yarn feeding means (1) and/or the yarn guiding means (8) with respect to the yarn picking means (2), or by lifting the yarn picking means (2) with respect to the yarn feeding means (1).

The details, shapes, sizes and the rest of accessory elements, used in the production of the method of the invention can be conveniently replaced by others that do not depart from the scope defined by the claims attached below.

The invention claimed is:

1. A process for yarn spinning and/or twisting, in which a yarn runs between a yarn feeder towards a yarn picker, and comprising:

a cursor located between at least one of the yarn picker or yarn feeder and a yarn guide, the picker being connected to a driver to rotate the yarn picker at a predetermined speed, in which a stretch of balloon is generated in a point located between the yarn feeder and the yarn picker because of the presence of a yarn twister comprising a ring having a diameter (DB) interactive with the cursor, wherein a value of the tension produced by the cursor is lower than in existing spinning and/or twisting processes for the same type of yarn and wherein a value of the rotation speed of the yarn twister and height of stretches of balloon (LB) is such that the yarn follows along a helical path with oscillating spire diameters (S) along a distance existing between the yarn guide and the cursor, such that the yarn, by operating the yarn twister, has a diameter generating two consecutive hyperboloid structures (E) forming a plurality of stretches of balloon (B) consecutive to each other that maintain an unchanged height throughout the process without recourse to apparatus elements in the yarn travel along the helical path between the cursor and the yarn guide.

2. The process of yarn spinning and/or twisting according to the claim 1, wherein the yarn has 2 to 20 hyperboloid structures (E).

3. The process of yarn spinning and/or twisting according to claim 1, wherein the height of the stretches of balloon (LB) is at least two times the diameter of the stretch of balloon (DB).

4. The process for yarn spinning and/or twisting according to the claim 3, wherein the height of the stretches of balloon (LB) ranges from 5 to 50 times the diameter of the stretch of balloon (DB).

5. The process for yarn spinning and/or twisting according to the claim 4, wherein the height of the stretches of balloon (LB) ranges from 5 to 25 times the diameter of the stretch of balloon (DB).

6. The process of yarn spinning and/or twisting according to claim 1, wherein the yarn picker is a winding bobbin (2).

7. The process of yarn spinning and/or twisting according to claim 1, wherein the yarn feeder is a supplying bobbin.

8. The process for yarn spinning and/or twisting according to claim 1, wherein the cursor is coupled to a bobbin rail connected to the yarn picker.

* * * * *